US005539437A

United States Patent [19]

Penwell

[11] Patent Number: 5,539,437

[45] Date of Patent: Jul. 23, 1996

[54] HYBRID THERMAL/HOT MELT INK JET PRINT HEAD

[75] Inventor: Richard C. Penwell, Penfield, N.Y.

[73] Assignee: Xerox Corporation, Stamford, Conn.

[21] Appl. No.: 179,399

[22] Filed: Jan. 10, 1994

[51] Int. Cl.[6] ..... B41J 2/04

[52] U.S. Cl. ..... 347/54; 347/68; 347/88

[58] Field of Search ..... 347/44, 54, 56, 347/65, 88, 94, 99, 68

[56] References Cited

U.S. PATENT DOCUMENTS

| | | | |
|---|---|---|---|
| 4,480,259 | 10/1984 | Kruger et al. | 347/54 |
| 4,496,960 | 1/1985 | Fischbeck et al. | 347/68 |
| 4,546,360 | 10/1985 | Fischbeck et al. | 347/61 |
| 4,620,198 | 10/1986 | Behun | 347/43 |
| 4,751,528 | 6/1988 | Spehrley, Jr. et al. | 347/102 X |
| 4,797,692 | 1/1989 | Ims . | |
| 4,998,120 | 3/1991 | Koto et al. | 347/70 |
| 5,113,200 | 5/1992 | Deguchi et al. | 347/101 X |
| 5,132,707 | 7/1992 | O'Neill | 347/65 |
| 5,172,135 | 12/1992 | Creagh et al. | 347/88 |

FOREIGN PATENT DOCUMENTS

| | | | |
|---|---|---|---|
| 61-37438 | 2/1986 | Japan | 347/94 |
| 2-111548 | 4/1990 | Japan | 347/88 |
| 2-111549 | 4/1990 | Japan | 347/88 |

*Primary Examiner*—John E. Barlow, Jr.

*Attorney, Agent, or Firm*—Fay, Sharpe, Beall, Fagan, Minnich & McKee

[57] ABSTRACT

A hybrid ink jet print head has at least one ink channel with an open end that serves as a nozzle. A first reservoir holds a hot melt ink and a first inlet allows the hot melt ink to flow from the first reservoir into the ink channel. A heater plate heats the hot melt ink held in the at least one ink channel. A second reservoir holds a thermal liquid and a second inlet allows the thermal liquid to flow into the ink channel. The second inlet is spaced further from the nozzle than is the first inlet. A heating element is positioned in the ink channel between the first and second inlets. An interconnect is secured at one end to the heating element. Selective application of current pulses along the interconnect to the heating element vaporizes the thermal liquid and forms a bubble in the ink channel. The bubble then acts on the hot melt ink in the ink channel to eject hot melt ink droplets at the nozzle.

26 Claims, 3 Drawing Sheets

HYBRID THERMAL/HOT MELT INK JET PRINT HEAD

BACKGROUND OF THE INVENTION

This invention relates to ink jet printing devices. More particularly, the present invention relates to a hybrid hot melt/thermal ink jet printhead having an array of coplanar nozzles in a nozzle face.

Thermal ink jet printing is a type of drop-on-demand ink jet system wherein an ink jet printhead expels ink droplets by the selective application of a current pulse to a thermal energy generator, usually a resistor, located in an ink channel a predetermined distance upstream from a channel nozzle or orifice. Usually, a plurality of capillary filled parallel ink channels are provided in the ink jet printing device. The channel ends opposite the respective nozzles are in communication with an ink reservoir to which an external ink supply is connected. The current pulses momentarily vaporize the ink and form bubbles on demand. Each temporary bubble expels an ink droplet and propels it towards a recording medium.

Such a printhead may be incorporated into either a carriage type printer or a pagewidth type printer. A carriage type printer generally has a relatively small printhead containing the ink channels and nozzles. The printhead is usually sealingly attached to a disposable ink supply cartridge in a combined printhead and cartridge assembly. This is reciprocated to print one swath of information at a time on a stationarily held recording medium, such as paper. After the swath of information is printed, the paper is stepped a distance equal to the height of the printed swath so that the next printed swath will be contiguous therewith. The procedure is repeated until the entire page is printed. In contrast, the pagewidth printer has a stationary printhead having a length equal to or greater than the width of the paper. The paper is continually moved past the printhead in a direction normal to the printhead at a constant speed during the printing process.

Such thermal ink jet printheads are known. One particularly advantageous thermal ink jet printhead is disclosed in U.S. Pat. No. 5,132,707 dated Jul. 21, 1992. That patent is incorporated herein by reference, in its entirety.

Thermal ink jet systems use inks prepared with water or another vaporizable solvent. Such inks require drying (i.e. vaporization of the solvent) after the ink has been applied to a substrate such as paper. In the absence of drying, the ink would smear on the paper and/or soak into the paper making the information represented by the ink difficult to comprehend.

Hot melt ink jets are similar to the thermal ink jets described above. However, a hot melt ink, contains no solvent. Thus, rather than being liquid at room temperature, a hot melt ink is typically a solid or semi-solid having a wax-like consistency. Such inks usually need to be heated to approximately 100° C. before the ink melts and turns into a liquid. As with the thermal ink jet, a plurality of ink jet nozzles are provided in a printhead. A piezoelectric vibrating element is located in each ink channel upstream from a nozzle so that the piezoelectric oscillations propel ink through the nozzle. After the hot melt ink is applied to the substrate, the ink is resolidified by freezing on the substrate.

Each of these types of known ink jets, however, has its own advantages and disadvantages. One advantage of thermal ink jets is their compact design for the integrated electronics section of the printhead. Thermal ink jets are disadvantageous in that the thermal ink has a tendency to soak into a plain paper medium. This blurs the print or thins out the print locally thereby adversely affecting print quality. Problems have been encountered with thermal ink jets in attempting to rid the ink of moisture fast enough so that the ink does not soak into a plain paper medium. This is particularly true when printing with color. Therefore, usually when printing with thermal ink, one needed to use coated papers, which are more expensive than plain paper.

One advantage of a hot melt ink jet is its ability to print on plain paper since the hot melt ink quickly solidifies as it cools and, since it is waxy in nature, does not normally soak into a paper medium. However, hot melt ink jets are cumbersome in structure and in design. That is, the associated integrated electronics of a thermal ink jet head are considerably more compact than those of a hot melt ink jet head.

Accordingly, it has been considered desirable to develop a new and improved hybrid thermal/hot melt ink jet printhead which would combine the advantages of a thermal ink jet with the advantages of a hot melt ink jet and avoid the disadvantages of both in a novel structure that would overcome the foregoing difficulties and others while providing better and more advantageous overall results.

BRIEF SUMMARY OF THE INVENTION

In accordance with the present invention, a new and improved hybrid ink jet printhead is provided.

More particularly in accordance with this aspect of the invention, the ink jet comprises at least one ink channel having an open end that serves as a nozzle and a first reservoir for holding a hot melt ink. A first inlet communicates the first reservoir with the ink channel. A heater plate is provided for heating the hot melt ink held in the at least one ink channel. A second reservoir is provided for holding a thermal liquid and a second inlet communicates the ink channel with the liquid. The second inlet is spaced further from the nozzle than is the first inlet. A heating element is positioned in the ink channel between the first and second inlets. An interconnect is secured at one end to the heating element. Selective application of current pulses along the interconnect to the heating element vaporizes the thermal liquid to form a bubble in the ink channel. The bubble then acts on the hot melt ink in the ink channel to eject hot melt ink droplets at the nozzle.

If desired, an intermediate barrier can be positioned in the ink channel between the hot melt ink and the liquid. In one embodiment, the intermediate barrier comprises a third fluid. In another embodiment, the intermediate barrier comprises a diaphragm. If desired, a means can be provided for retarding the flow of hot melt ink back into the first inlet. In one embodiment, such means can comprise a gate. In another embodiment, such means can comprise a ramp located adjacent the inlet. Also, if desired, a means can be provided for retarding the flow of thermal liquid back into the second inlet. In one embodiment, such means can comprise a gate. In another embodiment, such means can comprise a wall.

One advantage of the present invention is the provision of a new and improved hybrid thermal/hot melt ink jet printhead.

Another advantage of the present invention is the provision of an ink jet printhead which combines the compactness and integrated electronics of a thermal ink jet with the ability of a hybrid ink jet to print on plain paper, even in color.

Still another advantage of the present invention is the provision of an ink jet printhead in which a first fluid is employed for generating a bubble which then acts on a second fluid which is ejected onto a carrier medium.

Yet another advantage of the present invention is the provision of a hybrid thermal/hot melt ink jet printhead in which a thermal portion is optimized for bubble formation and a hot melt ink portion is optimized for ejecting and printing.

A further advantage of the present invention is the provision of a hybrid thermal/hot melt ink jet printhead in which means are provided for retarding the flow of both the thermal fluid and the hot melt ink back through their respective inlets.

A still further advantage of the present invention is the provision of a hybrid thermal/hot melt ink jet printhead in which an intermediate barrier is positioned in an ink channel between the hot melt ink and the thermal liquid. Such barrier can be either a third fluid or a diaphragm, as desired.

Still other advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the drawings described below.

DETAILED DESCRIPTION OF THE PREFERRED EMBODIMENTS

Figure 1:
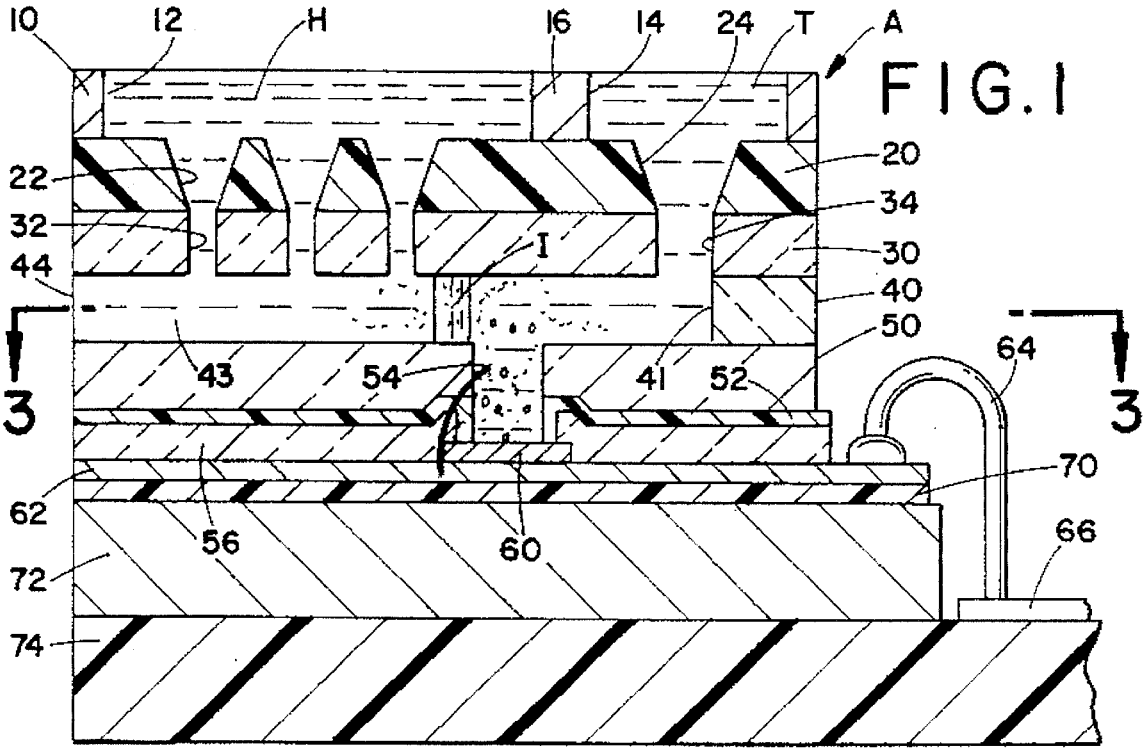
FIG. 1 is an enlarged cross-sectional view of a hybrid thermal/hot melt ink jet printhead according to a first preferred embodiment of the present invention showing a hot melt ink flow path between a hot melt ink reservoir and an ink channel having a nozzle, together with a thermal liquid flow path between a thermal liquid reservoir and the ink channel.

Referring now to the drawings, wherein the showings are for purposes of illustrating preferred embodiments of the invention only and not for purposes of limiting same, FIG. 1 shows a hybrid ink jet printhead A. While the ink jet printhead described hereinbelow is particularly adapted for printing on a carrier material such as plain paper, it should be appreciated that the ink jet printhead could be employed to print on many other varieties of carrier materials.

The ink jet printhead A comprises a reservoir layer 10 formed of any suitable material. Formed in the reservoir layer 10 is a hot melt ink reservoir section 12, for holding a hot melt ink H, as well as a thermal fluid reservoir section 14, for holding a thermal fluid T. These two are separated by a wall 16. Located below the reservoir layer 10 is a substrate layer 20, conventionally made out of a glass or ceramic material. Formed in the substrate layer is a first inlet 22 communicating with the hot melt fluid reservoir 12 as well as a second inlet 24 communicating with the thermal fluid reservoir 14. As is evident from FIG. 1, preferably a plurality of rather narrow inlets 22 are provided for the hot melt ink H in order to minimize a reverse flow of the hot melt ink back into its reservoir 12.

Located immediately below the substrate layer 20 is a first insulating layer 30. This layer can be made of a thick film insulative material such as Vacrel® or Riston® or a polyimide. Formed in the first insulating layer is a first inlet 32 which communicates with the first inlet 22 in the substrate layer. Also formed in the first insulating layer is a second inlet 34 which communicates with the second inlet 24 in the substrate layer 20. A second thick film insulating layer 40 is located directly below the first insulating layer 30. An inlet 41 in the second insulating layer allows the thermal fluid to flow from the second inlet 34 into a reservoir 42 (see FIG. 3) formed in the second insulating layer. The reservoir 42 communicates with a channel 43 which is also formed in the second insulating layer. The channel 43 terminates at a nozzle 44 formed in a nozzle face 46 of the printhead. As may be more evident from FIG. 2 of the drawings, a plurality of spaced nozzles 44 are located on the nozzle face 46.

If the printhead A is a multi-color ink jet printhead, each of the nozzles 44 can eject a different colored ink. Generally, prior art color printheads, such as the one disclosed in U.S. Pat. No. 4,620,198, employ four ink colors, namely, magenta, cyan, yellow and black. Obviously, in such a case, there would be four reservoirs 12, each reservoir holding a different color ink and each communicating with a respective nozzle 44.

Located immediately below the second insulating layer 40 is a third thick film insulating layer 50. Positioned beneath the third insulating layer is a first underglaze or passivation layer 52. Extending transversely through the third insulating layer 50 and the first underglaze layer 52 is a pit 54. A fourth insulating layer 56 is located below the first underglaze layer 52.

A heating element 60, located in the fourth insulating layer 56, has its upper face open to the pit 54. The heating element 60 will rapidly heat and vaporize the thermal fluid T and cause bubble formation therein. The bubble will in turn act on an intermediate fluid I positioned in the channel 43 between the hot melt ink H and the thermal fluid T. A shock wave will be generated in the intermediate fluid I. This shock wave will be propagated to the hot melt ink H and a droplet of ink will then be expelled at the nozzle 44. The heating element 60 is selectively heated when electricity is transmitted to an addressing electrode 62 which is in electrical contact with the heating element 60. A wire bond 64 extends between the addressing electrode 62 and a daughter board electrode 66. Located below the addressing electrode 62 is a second underglaze or passivation layer 70. Below that is a heater plate 72 which is employed to heat the hot melt ink H and keep it in a fluid state. A daughter board 74 is located below the heater plate and holds the daughter board electrode 66.

Figure 2:
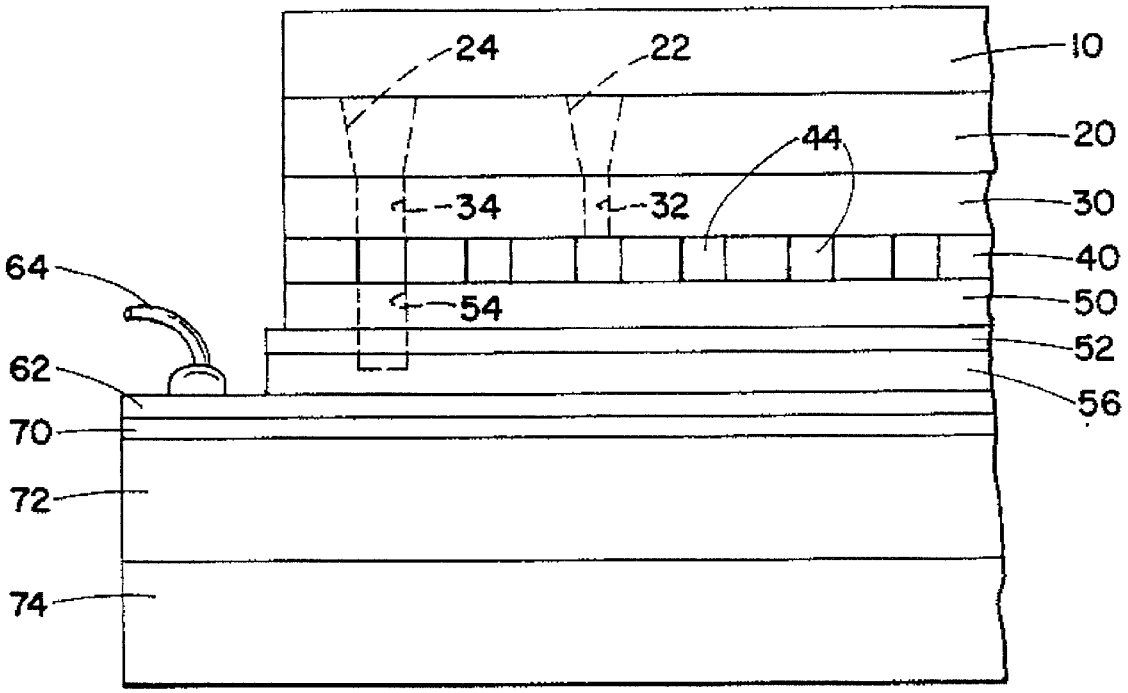
FIG. 2 is a partial front elevational view of the printhead of FIG. 1.
Figure 3:
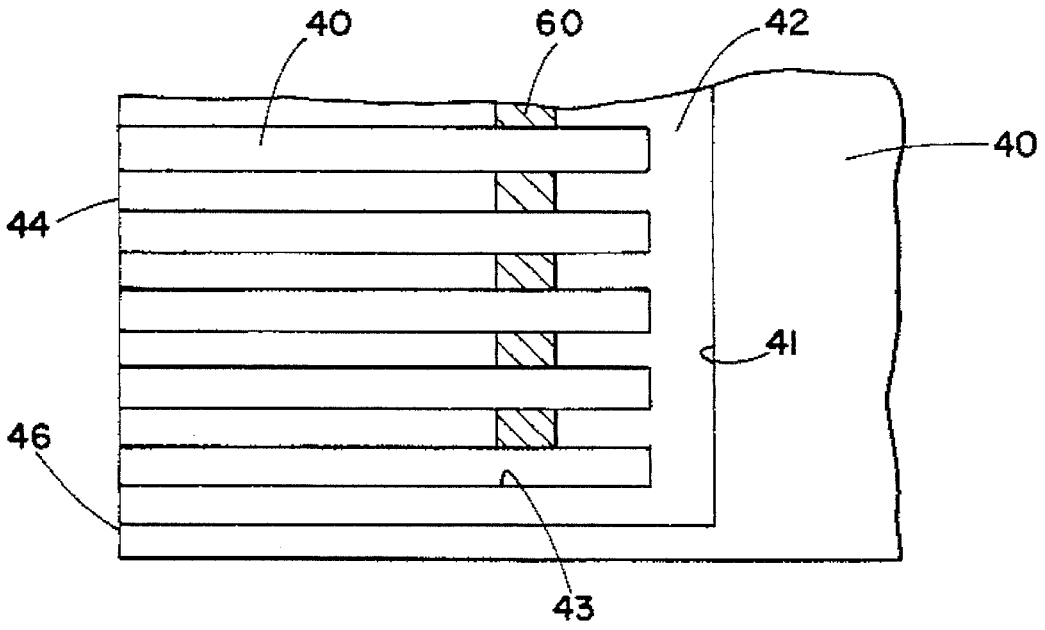
FIG. 3 is a partial top plan view of the printhead of FIG. 1 in cross-section as viewed along line 3—3 of FIG. 1.

It is evident from FIG. 3 of the drawings that the respective heating plates 60 are located at a distance from the nozzles 44 on the nozzle face 46 of the printheat A and that a plurality of channels 43 extend through the second insulating layer 40. From a comparison of FIGS. 1 and 2 of the instant application's drawings, it can be seen that wire bonds 64 can be provided on more than one side of the printhead as may be desired.

The thermal or bubble forming fluid or liquid can be made of a variety of conventional materials. These include water, hexane and propylene glycol, to name some. Water is considered to be the most advantageous since it vaporizes the most easily. It is also the least expensive and the most readily available material.

For the hot melt ink, which is solid at room temperatures but becomes liquid in the range of 100° to 120° C., a number of conventional materials are known. Standard materials include paraffins, waxes, stearons or amide stearates. Obviously, any of these materials need to have dyes added so as to form an ink.

Since the hot melt ink needs to be heated to a temperature of anywhere from 100° to 120° C., it is obvious that the thermal fluid cannot be simply water as plain water at that temperature would boil. Accordingly, the thermal fluid must be a mixture of water with another ingredient which will raise the boiling point of the water. Such ingredient can be ethylene glycol or the like. Since the hot melt ink H needs to be kept at a temperature of over 100° C., in order to keep it molten, the heater plate 72 will also heat the thermal fluid T to a like temperature. The thermal fluid would be heated to a higher temperature whenever the heating element 60 is energized thereby causing bubble formation in the thermal fluid.

Alternatively, a lower melting temperature hot melt ink can be used, i.e. one that is liquid at 80° or 90° C. Then plain water can be used as the thermal fluid. When the water is heated to 100° C. by the heating element 60, it will boil and bubbles will be formed therein.

The intermediate fluid can be made of any suitable conventional chemical such as propylene glycol or the like. Generally, the object of the intermediate fluid would be to prevent a mixing of the thermal fluid T with the hot melt ink H in order to prevent the ejection of the thermal fluid T along with the hot melt ink at the nozzle 44.

From FIG. 2, it can be seen that the thermal fluid inlets 24 and 34 are wider than the hot melt ink inlets 22 and 32. This is meant to prevent any backflow of the hot melt ink H up through the inlets and back into the reservoir 12 when acted upon by the intermediate fluid I after a bubble is formed in the thermal fluid T.

Figure 4:
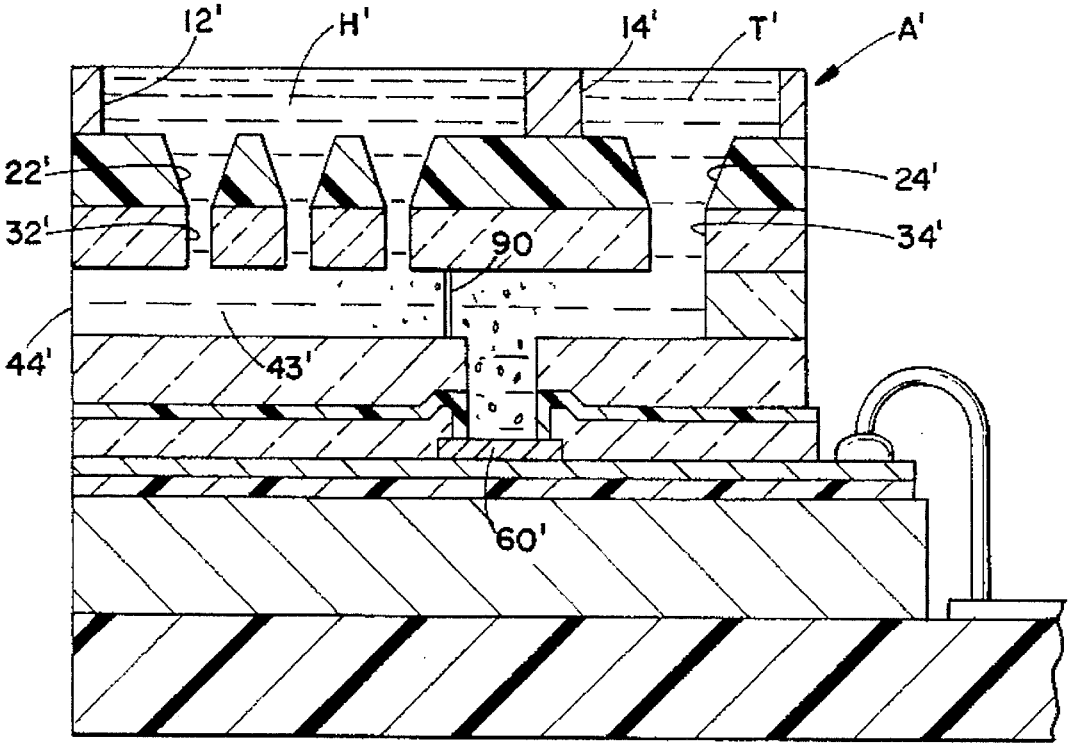
FIG. 4 is an enlarged cross-sectional view of a hybrid ink jet printhead according to a second preferred embodiment of the present invention.

With reference now to FIG. 4, a second preferred embodiment of a hybrid thermal/hot melt ink jet printhead according to the present invention is there illustrated. For ease of illustration and appreciation of this alternative, like components are identified by like numerals with a primed (') suffix and new components are identified by new numerals.

The hybrid ink jet A' comprises a hot melt ink reservoir 12' and a thermal fluid reservoir 14'. These communicate through respective inlets 22', 32' and 24', 34' with a channel 43'. Interposed in the channel 43' between a hot melt fluid H' and a thermal fluid T' is a membrane or diaphragm 90. This membrane is made from a suitable conventional resilient material which is impervious to air and liquid and is resistant to breaking even at temperatures in the range of 100° C. A heating element 60' is employed to vaporize the thermal fluid T' and form a bubble therein. The bubble would then act on the membrane 90 which, in turn, would act on the hot melt ink H' and expel it out through a nozzle 44'.

Figure 5:
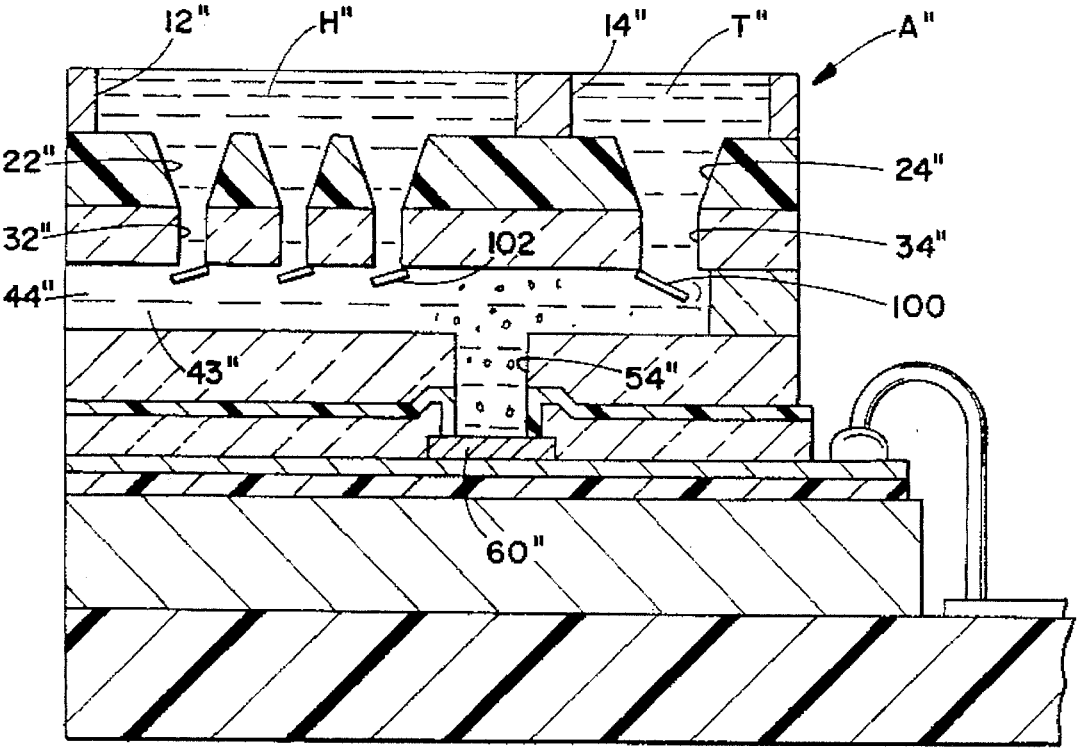
FIG. 5 is an enlarged cross-sectional view of a hybrid ink jet printhead according to a third preferred embodiment of the present invention; and, FIG. 6 is an enlarged cross-sectional view of an ink jet printhead according to a fourth preferred embodiment of the present invention.

With reference now to FIG. 5, a third preferred embodiment of a hybrid thermal/hot melt ink jet printhead according to the present invention is there illustrated. For ease of illustration and appreciation of this alternative, like components are identified by like numerals with a double primed suffix (") and new components are identified by new numerals.

In this embodiment of a hybrid thermal/hot melt ink jet printhead A", a hot melt ink H" flows from a hot melt ink reservoir 12" to a channel 43" through inlets 22" and 32". A thermal fluid T" flows from a thermal fluid reservoir 14" through inlets 24" and 34" into the channel 43". The thermal fluid T" is heated by a heating element 60" located in a pit 54". The thermal fluid T" is thus vaporized and bubbles are formed therein. In this embodiment, the bubbles in the thermal fluid act directly on the hot melt ink H" as no barrier means is provided between the thermal fluid T" and the hot melt ink H".

In order to prevent the pressure generated in the thermal T" fluid from pushing the thermal fluid back through its inlets 34", 24" and into its reservoir 14", a first gate 100 is located at the base of the inlet 34". As is evident, the gate is pivotable at one side. The gate pivots on the side closest to the pit 54 so that any pressure on the thermal fluid causing the thermal fluid to flow backwards, i.e. away from the nozzle 44", will cause the gate 100 to shut. Such pivoting gates or check valves in ink jet printheads are disclosed in U.S. Pat. No. 4,496,960 the disclosure of which is incorporated herein by reference in its entirety.

As the pressure on the thermal fluid T" is transfered to the hot melt ink H", the hot melt ink is also pressurized. In order to prevent the pressure formed in the hot melt ink from causing the hot melt ink H" to flow back through its respective inlets 32" and 22" to its reservoir 12", a gate 102 can be located at the bottom of the channel 32". As is evident, this gate is pivoted such that its pivot point is nearest to the pit 54". In this way, when the hot melt ink H" is pressurized, the pressure will tend to close the gate 102 thereby preventing the hot melt ink H" from flowing back up into the inlet 32". Rather, the hot melt ink will be caused to flow out through the nozzle 44".

Figure 6:
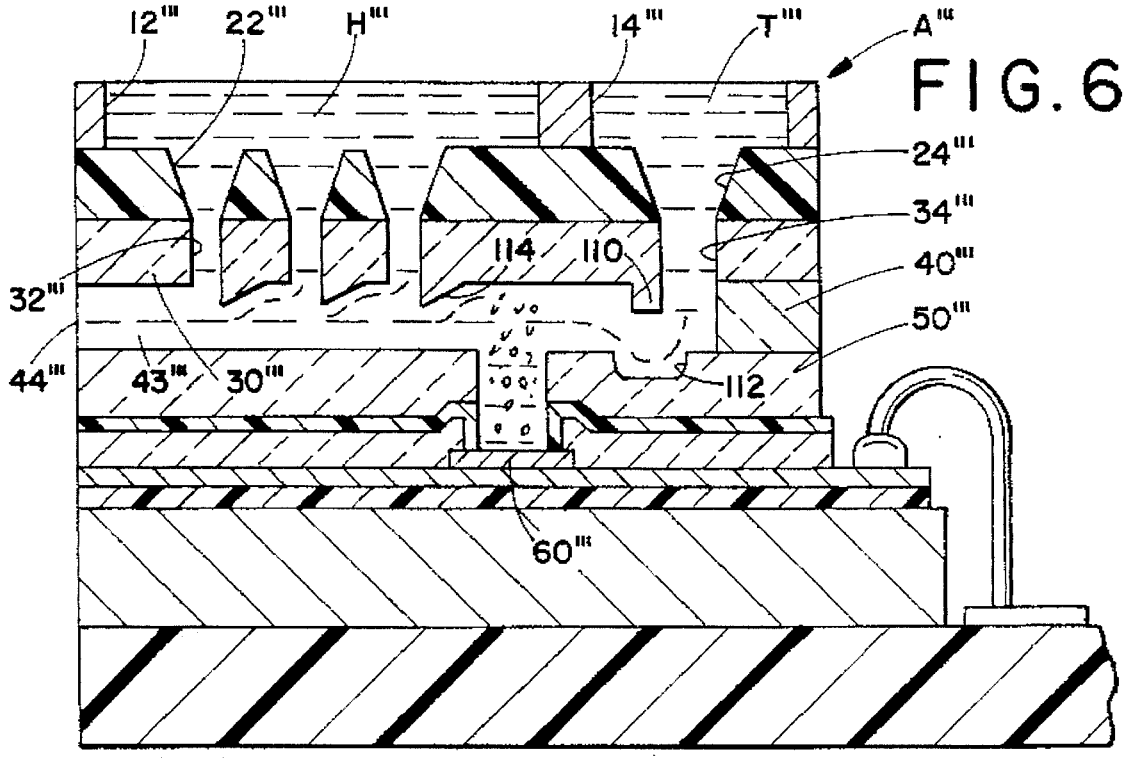

With reference now to FIG. 6, a fourth preferred embodiment of a hybrid thermal/hot melt ink jet printhead according to the present invention is there illustrated. For ease of illustration and appreciation of this alternative, like components are identified by like numerals with a triple primed suffix (''') and new components are identified by new numerals.

In this embodiment, a hot melt ink H''' flows from an ink reservoir 12''' through inlets 22''' and 32''' into a channel 43''' formed in a second insulative layer 40''' of the ink jet printhead. A thermal fluid T''' flows from its reservoir 14''' through inlets 24''' and 34''' into the channel 43'''. The thermal fluid T''' can flow into a pit 54''' so as to be acted upon by a heating element 60'''. The thermal fluid is thus vaporized. In order to prevent the thermal fluid in the channel 43''' from being urged back up into its reservoir 14''', a means is provided for retarding such reverse flow. In this embodiment, the means comprises a wall 110 extending down into the channel 42''' from a first insulating layer 30''' of the printhead. The wall 110 can be of one piece with the first insulating layer 30''' if desired. In order to provide an adequately large flow path for the thermal fluid T''', a depression 112 can be formed in the third insulating layer 50''' below the wall 110.

With this arrangement, a shock wave exerted on the thermal fluid T''' due to bubble formation therein, is reflected forwards due to the presence of the wall 110 and into the hot melt ink H'''. As in the embodiment of FIG. 5, there is no barrier provided between these two fluids in the embodiment of FIG. 6. A shock wave will thus be transmitted through the hot melt ink H'''. The shock wave will propel the hot melt ink H''' out through a nozzle 44'''.

In order to prevent the shock wave from pushing the hot melt ink H''' back into its reservoir 12''', a ramp 114 can be provided immediately adjacent each inlet 32'''. As can be seen, the ramp provides for a tapering or narrowing of the channel 42''' adjacent the inlet 32'''. The ramp 114 directs the hot melt ink H''' away from the inlet 32''' thereby retarding a flow of the hot melt ink back into the inlet. The ramp can be made of the same material as the first insulative layer 30''' if desired. Such ramps 114 can be integral or of one piece with the first insulating layer 30''', if so desired.

With an ink jet printhead design according to the present invention, the advantages of a thermal ink jet, i.e. compact integrated electronics in a compact printhead, can be joined with the advantages of a hot melt ink jet, i.e. its ability to print on plain paper. At the same time, the disadvantage of a thermal ink jet, i.e. its inability to print on plain paper and the disadvantage of a hot melt ink jet, i.e. its cumbersome structure, are avoided. Thus, in the printhead according to the present invention, the thermal fluid portion is optimized for bubble formation and the hot melt ink portion is optimized for ejecting and printing.

The invention has been described with reference to preferred embodiments. Obviously, modifications and alterations will occur to others upon the reading and understanding of this specification. It is intended to include all such modifications and alterations insofar as they come within the scope of the appended claims or the equivalents thereof.

I claim:

1. A hybrid ink jet print head comprising:

at least one ink channel having an open end that serves as a nozzle;

a first reservoir for holding a hot melt ink;

a first inlet for communicating said first reservoir with said ink channel;

a heater plate for heating said hot melt ink held in said at least one ink channel;

a second reservoir for holding a thermal fluid;

a second inlet for communicating said second reservoir with said ink channel, said second inlet being spaced further from said nozzle than is said first inlet;

a heating element positioned in the ink channel between said first inlet and said second inlet; and, an interconnect secured at one end to said heating element, wherein selective application of current pulses along the interconnect to the heating element vaporizes the thermal fluid to form a bubble therein, the bubble pressurizing the thermal fluid, the pressurized thermal fluid in the ink channel then acting on the hot melt ink in the ink channel to eject hot melt ink droplets at said nozzle.

2. The print head of claim 1 further comprising a barrier positioned in said ink channel between said hot melt ink and said thermal fluid.

3. The print head of claim 2 wherein said barrier comprises an intermediate fluid.

4. The print head of claim 2 wherein said barrier comprises a diaphragm.

5. The print head of claim 1 further comprising a means for retarding a flow of the hot melt ink back through said first inlet.

6. The print head of claim 5 wherein said means comprises a gate located at said first inlet.

7. The print head of claim 5 wherein said means comprises a first ramp located at said first inlet.

8. The print head of claim 1 further comprising a means for retarding a flow of the thermal fluid back through said second inlet.

9. The print head of claim 8 wherein said means comprises a gate located at said second inlet.

10. The print head of claim 8 wherein said means comprises a wall located in said ink channel between said heating element and said second inlet.

11. An ink jet printing apparatus for printing with an ink that is normally in a solid phase or of high viscosity at room temperature and in a liquid phase at elevated temperatures, the apparatus comprising:

an ink jet print head comprising at least one ink channel having an open end that serves as a nozzle;

a first reservoir for holding a hot melt ink;

a first inlet for communicating said first reservoir with said ink channel;

a second reservoir for holding a thermal liquid;

a second inlet for communicating said second reservoir with said thermal liquid, said second inlet being spaced from said first inlet;

a heating element positioned in the ink channel between said first inlet and said second inlet; and, an interconnect connected at one end to said heating element, wherein selective application of current pulses along the interconnect to the heating element heats the thermal liquid to form a bubble therein, the bubble pressurizing the thermal liquid, the pressurized thermal liquid then acting on the hot melt ink in the ink channel to eject hot melt ink droplets at said nozzle.

12. The print head of claim 11 further comprising an intermediate barrier positioned in said ink channel between said hot melt ink and said thermal liquid.

13. The print head of claim 11 wherein the thermal liquid comprises water.

14. The print head of claim 11 further comprising a gate located at said first inlet.

15. The print head of claim 11 further comprising a gate located at said second inlet.

16. The print head of claim 11 further comprising a third inlet communicating said first reservoir and said ink channel.

17. The print head of claim 11 wherein a plurality of spaced ink channels are defined in said print head and a plurality of heating elements are provided one for each of the respective channels.

18. A hybrid ink jet print head comprising:

a lower rigid substrate having formed on one surface thereof an array of heating elements and associated addressing electrodes with contact pads for electrical connection thereto, the addressing electrodes enabling the selective addressing of individual heating elements with a current pulse representing digitized data signals;

a passivation layer deposited over said lower substrate and the heating elements and addressing electrodes formed thereon, the passivation layer being removed from the heating elements and contact pads;

a first thick film layer deposited over the passivation layer and being patterned to remove the first thick film layer over the heating elements and contact pads so that the removed first thick film layer over the heating elements places them in a pit;

a second thick film layer deposited over said first thick film layer and patterned to form a plurality of parallel ink channels perpendicularly connected to a common reservoir at one end, the other channel ends being open and each channel containing a heating element in its respective pit a predetermined distance upstream from the channel open end;

an upper rigid substrate having spaced first and second through holes;

a third thick film layer deposited on one surface of said upper rigid substrate, said third thick film layer being patterned to form a recess equal in size to the common reservoir recess in said second thick film layer and to clear the first and second through holes;

a hot melt ink reservoir communicating with said first through hole;

a thermal liquid reservoir communicating with said second through hole, wherein selective application of current pulses to a selected one of the array of heating elements heats the thermal liquid to form a bubble in a selected ink channel, the bubble then pressurizing the thermal liquid, the pressurized thermal liquid then acting on the hot melt ink in the selected ink channel to eject hot melt ink droplets at said nozzle.

19. The print head of claim 18 further comprising a third inlet communicating said first reservoir and said ink channel.

20. The print head of claim 18 further comprising a barrier positioned in said ink channel between said hot melt ink and said thermal liquid.

21. The print head of claim 18 further comprising a means for retarding a flow of the hot melt ink back through said first inlet.

22. The print head of claim 18 further comprising a means for retarding a flow of the thermal liquid back through said second inlet.

23. A method for discrete ink droplet ejection from an orifice of an ink jet print head, comprising the steps of:

providing a hot melt ink;

providing a thermal liquid;

flowing the hot melt ink into an ink channel having an outlet orifice;

flowing the thermal liquid into the ink channel and into a pit or channel communicating therewith prior to bubble formation;

heating the thermal liquid in the pit or channel to cause bubble formation therein;

directing the propagation of shock waves from the thermal liquid surrounding the bubble to the thermal liquid in the ink channel;

directing the propagation of shock waves from the thermal liquid in the ink channel to the hot melt ink; and, causing a discrete ink droplet to be ejected from the print head orifice.

24. The method of claim 23 further comprising the step of retarding a backflow of the thermal liquid back into the thermal liquid reservoir.

25. The method of claim 23 further comprising the step of retarding a flow of the hot melt ink back into the hot melt ink reservoir.

26. The method of claim 23 further comprising the step of positioning a barrier in the ink channel between said thermal liquid and said hot melt ink and, wherein said step of directing the propagation of shock waves from the thermal liquid in the ink channel to the hot melt ink comprises the subsidiary steps of causing the shock waves in said thermal liquid to act on said barrier and then causing the barrier or shock waves formed therein to act on the hot melt ink.

* * * * *